US010391528B2

(12) United States Patent
Park et al.

(10) Patent No.: US 10,391,528 B2
(45) Date of Patent: Aug. 27, 2019

(54) CLEANING APPARATUS USING LIQUID MIXED WITH GAS

(71) Applicant: Jong-ha Park, Seoul (KR)

(72) Inventors: Jong-ha Park, Seoul (KR); Jung-ho Cho, Gyeonggi-do (KR); Il-kwang Seo, Gyeonggi-do (KR); Chae-hyeong Chang, Gyeonggi-do (KR)

(73) Assignee: Jong-Ha Park, Seoul (KR)

( * ) Notice: Subject to any disclaimer, the term of this patent is extended or adjusted under 35 U.S.C. 154(b) by 0 days.

(21) Appl. No.: 15/505,395

(22) PCT Filed: Feb. 16, 2015

(86) PCT No.: PCT/KR2015/001516
§ 371 (c)(1),
(2) Date: Mar. 1, 2017

(87) PCT Pub. No.: WO2016/027950
PCT Pub. Date: Feb. 25, 2016

(65) Prior Publication Data

US 2017/0266701 A1 Sep. 21, 2017

(30) Foreign Application Priority Data

Aug. 18, 2014 (KR) ..... 10-2014-0106910

(51) Int. Cl.
*B08B 9/032* (2006.01)
*B67D 1/07* (2006.01)

(52) U.S. Cl.
CPC ..... *B08B 9/0328* (2013.01); *B08B 9/0325* (2013.01); *B67D 1/07* (2013.01)

(58) Field of Classification Search
None
See application file for complete search history.

(56) References Cited

U.S. PATENT DOCUMENTS 2,591,985 A * 4/1952 Warcup ..... B08B 9/0323 137/212
6,240,952 B1 * 6/2001 Schroeder ..... B08B 9/0325 134/169 R
2010/0024842 A1 * 2/2010 Kholodenko ..... B01F 3/04446 134/2

FOREIGN PATENT DOCUMENTS

EP 0409305 B1 9/1993
JP 11-13113 A 1/1999
JP 11-63327 A 3/1999
JP 2002-143722 A 5/2002
(Continued)

OTHER PUBLICATIONS

International Search Report for PCT/KR2015/001516.

*Primary Examiner* — Katelyn B Whatley
(74) *Attorney, Agent, or Firm* — The PL Law Group, PLLC

(57) ABSTRACT

A cleaning apparatus using a gas-mixed liquid includes a first inlet port into which a liquid supplied from the outside is introduced, a second inlet port into which a gas to be mixed with the liquid introduced from the first inlet port is introduced, a mixing chamber in which the liquid introduced from the first inlet port and the gas introduced from the second inlet port are mixed with each other, and an outlet port through which the liquid mixed with the gas in the mixing chamber is discharged. According to the present invention, it is possible to efficiently remove slime such as scale generated in a variety of industrial conduits in which liquids flow, and germs, etc. deposited in various conduits.

10 Claims, 3 Drawing Sheets

(56) References Cited

FOREIGN PATENT DOCUMENTS

| | | | | |
|---|---|---|---|---|
| JP | 2003-190845 | A | | 7/2003 |
| JP | 2003190845 | A | * | 7/2003 |
| JP | 2004-202316 | A | | 7/2004 |
| JP | 2004202316 | A | * | 7/2004 |
| JP | 2006-187707 | A | | 7/2006 |
| JP | 2008-183538 | A | | 8/2008 |
| JP | 3157938 | U | | 2/2010 |
| JP | 2010-172786 | A | | 8/2010 |
| JP | 2011-133125 | A | | 7/2011 |
| KR | 10-0588047 | B1 | | 6/2006 |
| KR | 10-0622287 | B1 | | 9/2006 |
| KR | 10-2011-0052598 | A | | 5/2011 |
| KR | 10-2012-0058049 | A | | 6/2012 |
| WO | WO 2010/067454 | A1 | | 6/2010 |

* cited by examiner

CLEANING APPARATUS USING LIQUID MIXED WITH GAS

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2015/001516, filed Feb. 16, 2015, which claims priority to the benefit of Korean Patent Application No. 10-2014-0106910 filed in the Korean Intellectual Property Office on Aug. 18, 2014, the entire contents of which are incorporated herein by reference.

The present invention relates to a cleaning apparatus using a liquid mixed with a gas ('gas-mixed liquid'), and more particularly, to a cleaning apparatus using a gas-mixed liquid capable of effectively removing slime such as scale generated in a variety of industrial conduits in which liquids flow, and germs, etc. deposited in various conduits.

BACKGROUND ART

In liquid supply pipes widely used in industrial facilities, such as a pipeline of a ship, a pipe of a sewage sludge treatment facility, an internal pipe of a construction plant facility, and a beverage supply pipe in beverage equipment such as used for beer, foreign matters such as scale, germs, etc. are deposited on an inner wall surface thereof due to properties of the liquid contained therein and environmental factors at sites where the facilities are installed.

Specifically, when various types of liquids such as food and beverages flow in the conduit for a long period of time, corrosion occurs on an inner surface of the conduit. Corrosion refers to a phenomenon in which metal contacts with a surrounding liquid or gas to chemically or electrochemically react therewith, thereby causing damage. Another definition for the corrosion may be described as the following phenomenon in which:

A) a change occurs in a conduit carrying water due to external physical effects;

B) a substance which is not chemically stable comes into contact with any substance to cause an electrical change, and a chemical change occurs in that region;

C) every substance has its own electric potential, and when a substance having a different electric potential approaches a substance having such electric potential, a magnetic reaction occurs to form foreign matters; and D) oxygen acts on a substance to cause a change (oxidation).

Meanwhile, in a comprehensive sense, the corrosion may be defined as a phenomenon in which a material is deteriorated due to the environment.

Further, slime referred to as so-called fur is deposited on the inner surface of the conduit. The slime deposited on the inner surface of the conduit as described above not only spoils the flavor of a liquid for drinking, but also becomes a site where germs, etc. may grow, thereby causing a contamination of the corresponding liquid.

In particular, in a general water pipe, slime is generated in a form of a scale deposited due to the corrosion in the conduit, and scale is deposited in another form of slime in a conduit for drawing food and beverages.

Meanwhile, as disclosed in Korean Patent Registration No. 10-0588047, conventionally, there has been an attempt to remove the slime such as scale by injecting a slime removing agent into the conduit or by injecting high-pressure washing water.

However, the conventional method of removing slime has problems of not only decreasing a removal efficiency, but also leading to harmful results to a human body due to a chemical composition contained in the agent when using the slime removing agent, and causing environmental pollution.

SUMMARY

Accordingly, it is an object of the present invention to provide a cleaning apparatus using a gas-mixed liquid capable of effectively removing slime such as scale generated in a variety of industrial conduits through which liquids flow, and germs, etc. deposited in various conduits.

In order to accomplish the above object, according to an aspect of the present invention, there is provided a cleaning apparatus using a gas-mixed liquid, including: a first inlet port into which a liquid supplied from an outside is introduced; a second inlet port into which a gas to be mixed with the liquid introduced from the first inlet port is introduced; a mixing chamber in which the liquid introduced from the first inlet port and the gas introduced from the second inlet port are mixed with each other; and an outlet port through which the liquid mixed with the gas in the mixing chamber is discharged.

Preferably, the liquid is water, and the gas is carbon dioxide gas or nitrogen gas.

In addition, the liquid discharged through the outlet port may be discharged accompanied with surging (a pulsation phenomenon).

According to another aspect of the present invention, there is provided a cleaning apparatus using a gas-mixed liquid, including: a first inlet port into which a liquid supplied from an outside is introduced; a second inlet port into which a gas to be mixed with the liquid introduced from the first inlet port is introduced; a mixing chamber in which the liquid introduced from the first inlet port and the gas introduced from the second inlet port are mixed with each other; and an outlet port through which the liquid mixed with the gas in the mixing chamber is discharged, wherein the gas may form micro bubbles in the liquid.

Preferably, the liquid is water, and the gas is carbon dioxide gas or nitrogen gas.

In addition, the liquid discharged through the outlet port may be discharged accompanied with surging.

Further, the cleaning apparatus using a gas-mixed liquid may further include a sintered body installed between the second inlet port and the mixing chamber.

According to the present invention, it is possible to effectively remove slime such as scale generated in a variety of industrial conduits through which liquids flow, and germs, etc. deposited in various conduits.

DETAILED DESCRIPTION

Figure 1:
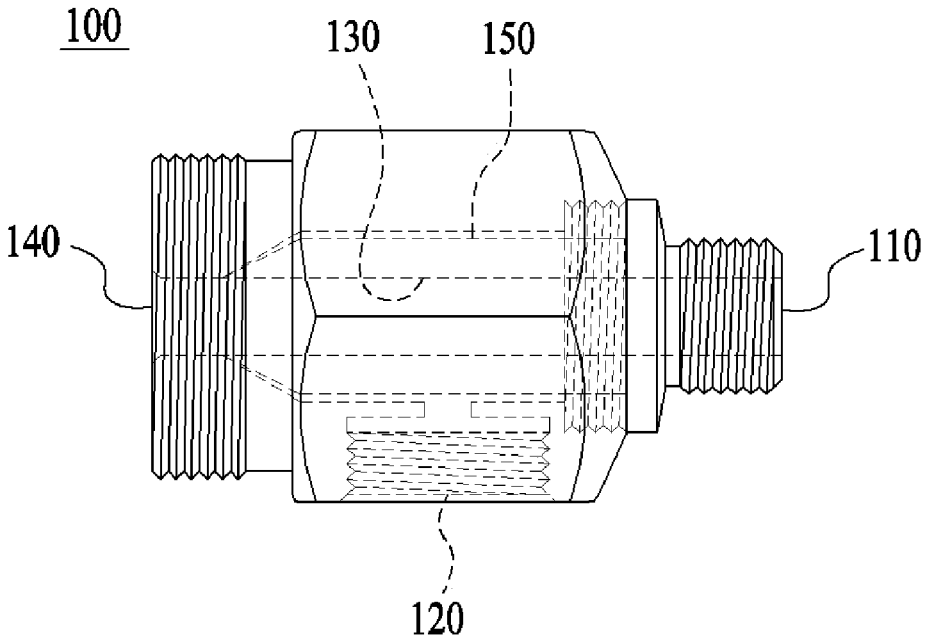
FIG. 1 is a view illustrating a structure of a cleaning apparatus using a gas-mixed liquid according to one embodiment of the present invention.

Hereinafter, the present invention will be described with reference to the accompanying drawings in detail. Referring to the drawings, wherein like reference characters designate like or corresponding parts throughout the several views. In the embodiments of the present invention, the publicly known functions and configurations that are judged to be able to make the purport of the present invention unnecessarily obscure will not be described.

Figure 2:
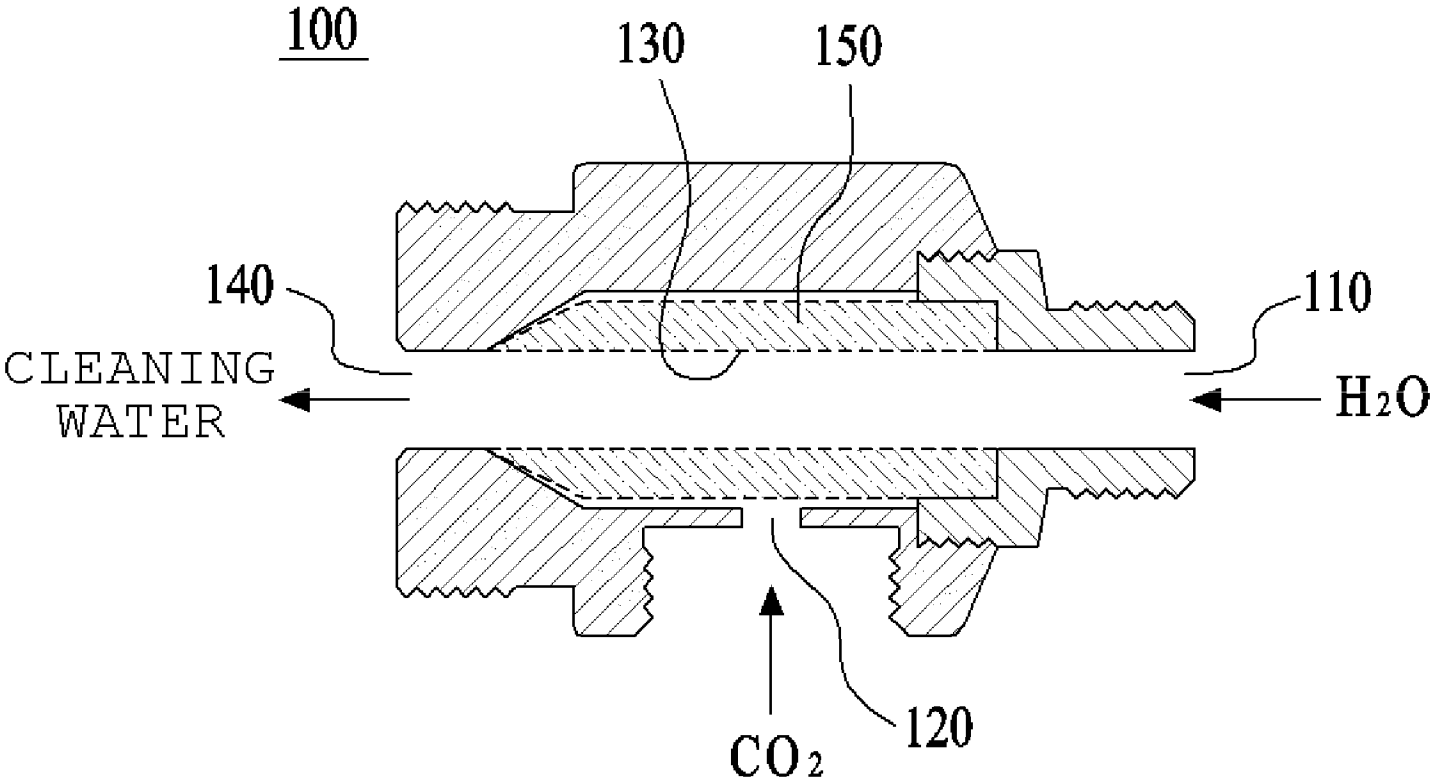
FIG. 2 is a cross-sectional view illustrating the structure of the cleaning apparatus using a gas-mixed liquid according to one embodiment of the present invention illustrated in FIG. 1.

FIG. 1 is a view illustrating a structure of a cleaning apparatus using a gas-mixed liquid 100 according to one embodiment of the present invention, and FIG. 2 is a cross-sectional view illustrating the structure of the cleaning apparatus using a gas-mixed liquid 100 according to one embodiment of the present invention illustrated in FIG. 1.

Referring to FIGS. 1 and 2, the cleaning apparatus using a gas-mixed liquid 100 includes a first inlet port 110, a second inlet port 120, a mixing chamber 130, and an outlet port 140.

A liquid such as water supplied from an external supply pipe, which is fastened to the first inlet port 110, is introduced into the first inlet port 110. The liquid introduced into the cleaning apparatus 100 through the first inlet port 110 as described above is mixed with a gas such as carbon dioxide gas or nitrogen gas introduced from the second inlet port 120 in the mixing chamber 130.

Meanwhile, the liquid mixed with the gas in the mixing chamber 130 is supplied to a discharge pipe (not illustrated), which is connected to the outlet port 140, through the outlet port 140. A cleaning water, which is the gas-mixed liquid discharged to an outside through the outlet port 140, cleans and washes an inside of various industrial pipes connected to the discharge pipe.

The industrial pipes that can be cleaned and washed by the cleaning water discharged through the cleaning apparatus 100 according to the present invention may be a pipeline of a ship, a pipe of a sewage sludge treatment facility, an internal pipe of a construction plant facility, and a beverage supply pipe in beverage equipment such as used for beer. Foreign matters such as scales, germs, etc. deposited inside of the various industrial pipes can be cleaned through the cleaning apparatus 100 according to the present invention.

Meanwhile, the cleaning water supplied to the inside of the pipe to be cleaned through the outlet port 140 of the cleaning apparatus 100 according to the present invention is discharged into the pipe to be cleaned accompanied with surging.

The surging in the present disclosure refers to a pulsation phenomenon in which a pressure and a discharge amount of the liquid periodically fluctuate in the flow of the liquid with all surfaces in the pipe in contact with the liquid, which causes periodic vibrations in the pipe.

There are various causes of such surging, but it is known that the surging may occur in a case in which the pipe has a long discharge pipe line, and a portion where air such as an air pocket is collected exists inside of the pipe.

Meanwhile, such surging is a factor that hinders a smooth flow of the fluid in the pipe, and generally, methods for preventing surging such as removing the air in the pipe, or controlling a sectional area, flow velocity, or flow rate of the pipe have been studied. However, in the present invention, a method of washing and cleaning an inner portion of the pipe through vibrations generated in the pipe by surging and an amount of impact applied to the wall surface of the pipe is proposed.

That is, the present inventor confirmed that, if a liquid such as water is supplied to the mixing chamber 130 having the shape and structure as illustrated in FIGS. 1 and 2 through the first inlet port 110, and in this state, when a gas such as carbon dioxide gas is forcibly injected through the second inlet port 120 in a direction perpendicular to a flow path of the liquid, the cleaning water discharged through the outlet port 140 of the cleaning apparatus 100 is discharged to the inside of the pipe to be cleaned accompanied with the surging, and has completed the present invention.

Meanwhile, when implementing the present invention, in order to enhance cleaning and sterilization effects by the cleaning water discharged through the outlet port 140, it is preferable that a gas, which is supplied to the mixing chamber 130 through the second inlet port 120 and mixed with the liquid, is a gas such as carbon dioxide gas that is bubbled into an ultrafine size.

That is, if fine bubbles are formed in the liquid by the gas such as carbon dioxide gas, the cleaning and sterilization effects by the cleaning water may be more increased. To this end, in the present invention, as illustrated in FIGS. 1 and 2, it is preferable that a sintered body 150 is installed between the second inlet port 120 and the mixing chamber 130.

Specifically, the gas such as carbon dioxide gas supplied through the second inlet port 120 is separated into micro-sized fine particles while passing through the sintered body 150. The gas separated into the fine particles is mixed with the liquid introduced through the first inlet port 110 in the mixing chamber 130, such that the cleaning water discharged through the outlet port 140 contains microbubbles generated by the carbon dioxide gas, or the like.

According to experiments in the process of the present invention, it could be confirmed that, when the cleaning water is discharged accompanied with the surging, the micro bubbles included in the cleaning water rarely disappeared, and cleaning and sterilizing powers due to the microbubbles were also maintained even through a relatively long flow path, as compared to the case in which the cleaning water is not accompanied with the surging.

Meanwhile, various microbubbling apparatuses or means may be used when implementing the present invention other than the sintered body 150, so that microbubbles are contained in the liquid mixed with the gas in the mixing chamber 130.

Figure 3:
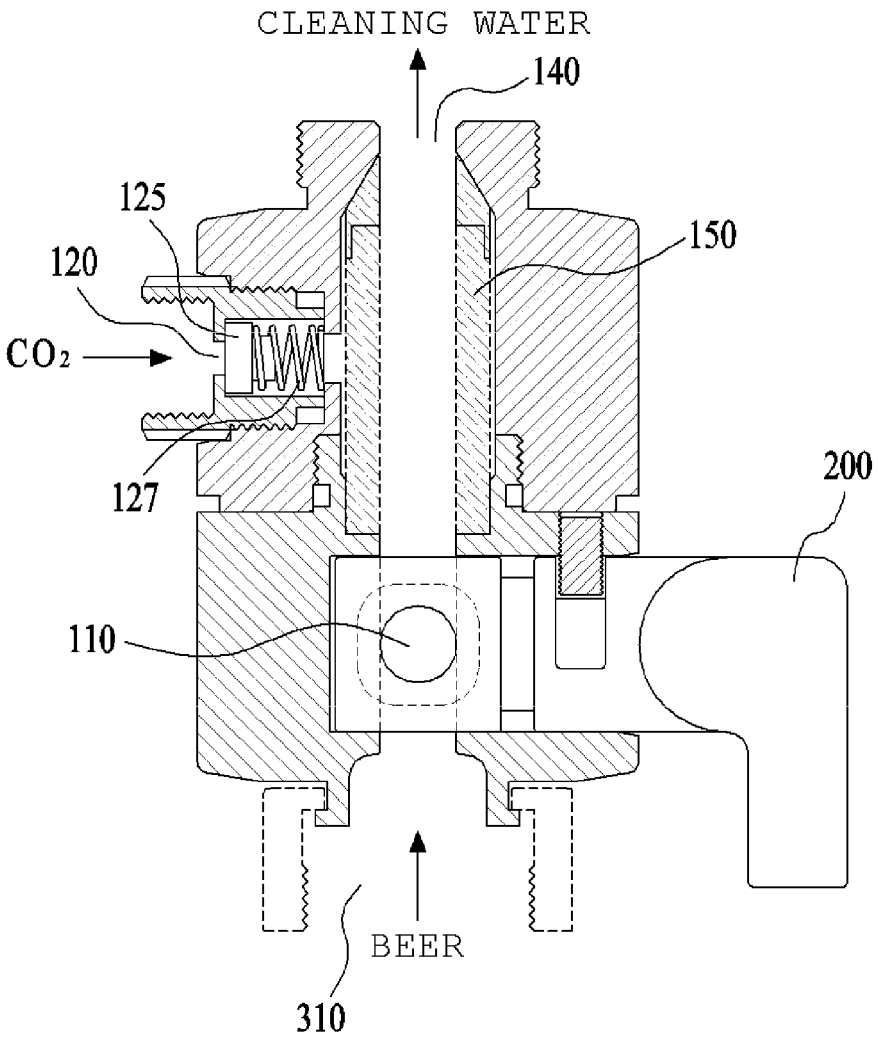
FIG. 3 is a cross-sectional view illustrating a structure in which a cleaning apparatus using a gas-mixed liquid according to another embodiment of the present invention is installed.

FIG. 3 is a cross-sectional view illustrating a structure in which a cleaning apparatus using a gas-mixed liquid 100 according to another embodiment of the present invention is installed.

The basic structure and function of the cleaning apparatus using liquid mixed gas 100 according to another embodiment of the present invention illustrated in FIG. 3 are the same as those of the cleaning apparatus using a gas-mixed liquid 100 according to one embodiment of the present invention described through FIGS. 1 and 2. That is, as illustrated in FIG. 3, the cleaning apparatus using a gas-mixed liquid 100 according to another embodiment of the present invention further includes a check valve 125 installed in the second inlet port 120 into which the gas is introduced.

When the gas is not introduced into the second inlet port 120, the second inlet port 120 is blocked by the check valve 125 which is electrically supported by an elastic member 127 such as a spring in the second inlet port 120, thus to prevent the liquid in the mixing chamber 130 from flowing back through the second inlet port 120.

Meanwhile, as illustrated in FIG. 3, the cleaning apparatus using a gas-mixed liquid 100 according to another embodiment of the present invention includes a three-way valve 200 installed therein. By controlling the three-way valve 200, a user may control opening and closing of a beverage inlet port 310 such as used for beer, which is coupled to a lower portion of the cleaning apparatus 100, as well as control opening and closing of the first inlet port 110.

That is, when the user opens the beverage inlet port 310 such as used for beer, which is coupled to the lower portion of the cleaning apparatus 100, through the control of the three-way valve 200, it is possible to control so that beverage such as beer supplied from the beverage inlet port 310 passes through the mixing chamber 130 and is discharged to an outside of the cleaning apparatus through an outlet port 140. In addition, when the user closes the beverage inlet port 310 such as used for beer, which is coupled to the lower portion of the cleaning apparatus 100, and opens the first inlet port 110 through the control of the three-way valve 200, it is possible to control so that the supply of beverage such as beer from the beverage inlet port 310 is blocked and the cleaning liquid such as water is supplied into the mixing chamber 130 through the first inlet port 110, thereby performing the cleaning operation by the cleaning apparatus 100 according to the present invention.

In addition, the terminology used herein is for the purpose of describing particular embodiments only and is not intended to limit the present invention thereto. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

While the present invention has been described with reference to the preferred embodiments and modified examples, the present invention is not limited to the above-described specific embodiments and the modified examples, and it will be understood by those skilled in the related art that various modifications and variations may be made therein without departing from the scope of the present invention as defined by the appended claims, as well as these modifications and variations should not be understood separately from the technical spirit and prospect of the present invention.

The present invention may be applied to industrial conduits, such that industrial applicability thereof may be recognized in the industrial conduit related industrial fields.

The invention claimed is:

1. A cleaning apparatus using a gas-mixed liquid, comprising:

a liquid;

a first inlet port into which the liquid supplied from an outside is introduced;

a gas;

a second inlet port into which the gas to be mixed with the liquid introduced from the first inlet port is introduced, the second inlet port perpendicularly positioned to the first inlet port;

a mixing chamber having the gas mixed with the liquid, the liquid introduced from the first inlet port, the gas introduced from the second inlet port;

a beverage inlet port into which a beverage flows, the beverage inlet port connecting to mixing chamber;

an outlet port through which the liquid mixed with the gas in the mixing chamber and the beverage in the mixing chamber is discharged; and a three-way valve to control an opening and a closing of the beverage inlet port as well as an opening and a closing of the first inlet port.

2. The cleaning apparatus of claim 1, wherein the liquid consists of water, and the gas is carbon dioxide gas or nitrogen gas.

3. The cleaning apparatus of claim 1, wherein the liquid discharged through the outlet port is discharged accompanied with surging.

4. The cleaning apparatus of claim 1, further comprising:

a check valve installed in the second inlet port to block the second inlet port when the gas is not introduced into the second inlet port; and an elastic member electrically supporting the check valve in the second inlet port to prevent the liquid in the mixing chamber from flowing back through the second inlet port.

5. The cleaning apparatus of claim 4, wherein the elastic member is a spring.

6. The cleaning apparatus of claim 1, wherein the mixing chamber is interconnected only to three ports of the first inlet port, the second inlet port and the beverage inlet port.

7. The cleaning apparatus of claim 1, wherein the beverage is beer.

8. The cleaning apparatus of claim 1, further comprising a sintered body installed between the second inlet port and the mixing chamber, the sintered body having a structure enabling the gas supplied through the second inlet port to pass therethrough and to separate the gas into micro-sized fine particles while passing through the sintered body.

9. The cleaning apparatus of claim 1, wherein the first inlet port and the second inlet port are directly connected to the mixing chamber.

10. The cleaning apparatus of claim 1, wherein the beverage inlet port is formed in one end of the cleaning apparatus, and the outlet port is formed in the other end opposite to said one end of the cleaning apparatus.

* * * * *